US010215521B1

(12) United States Patent
Huang

(10) Patent No.: US 10,215,521 B1
(45) Date of Patent: Feb. 26, 2019

(54) TITANIUM OFFSET STRING BUMPER

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 15/909,132

(22) Filed: Mar. 1, 2018

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/86, 88, 89
See application file for complete search history.

(56) References Cited

U.S. PATENT DOCUMENTS 4,061,125 A * 12/1977 Trotter ..... F41B 5/14 124/23.1
4,461,267 A * 7/1984 Simonds ..... F41B 5/10 124/25.6
5,522,376 A * 6/1996 Collinsworth ..... F41B 5/1461 124/23.1
5,531,211 A * 7/1996 Wilfong, Jr. ..... F41B 5/14 124/25.6
5,613,484 A * 3/1997 Troncoso ..... F41B 5/1426 124/86
5,720,269 A * 2/1998 Saunders ..... F41B 5/1407 124/25.6
6,634,348 B2 * 10/2003 Gallops, Jr. ..... F41B 5/1407 124/25.6
6,715,479 B1 * 4/2004 Bunk ..... F41B 5/10 124/25.6
6,966,314 B2 * 11/2005 McPherson ..... F41B 5/105 124/25.6
7,721,724 B2 * 5/2010 Goade ..... F41B 5/1426 124/86
7,793,646 B2 * 9/2010 Cooper ..... F41B 5/1407 124/86
8,011,356 B2 * 9/2011 Gordon ..... F41B 5/1426 124/25.6
8,033,277 B2 * 10/2011 Gordon ..... F41B 5/1426 124/25.6
8,056,548 B1 * 11/2011 Larson ..... F41B 5/1426 124/23.1
8,272,374 B2 * 9/2012 Cooper ..... F41B 5/1426 124/25.6

(Continued)

OTHER PUBLICATIONS

Screen shot of www.scorpyd.com/deathstalker-crossbow with two string stops fabricated of titanium.

(Continued)

*Primary Examiner* — Alexander R Niconovich
(74) *Attorney, Agent, or Firm* — Donald J. Ersler

(57) ABSTRACT

A titanium string bumper preferably includes a bumper rod and a rubber bumper. The bumper rod includes a base portion, an offset portion and a bumper portion. The bumper rod preferably includes a round cross section. A thread may be formed on one end of the base portion and one end of the offset portion extends from an opposing end of the base portion. The offset portion forms an angle of between 60-165 degrees with the base portion. One end of the bumper portion extends from an opposing end of the offset portion. The rubber bumper includes an inwardly curved front to receive a bowstring and a rod bore, which is sized to receive the bumper portion. The bumper portion is pushed into the rod bore. The base portion is retained in a riser of an archery bow.

18 Claims, 1 Drawing Sheet

(56) References Cited

U.S. PATENT DOCUMENTS

| | | | | |
|---|---|---|---|---|
| 8,276,576 | B1 * | 10/2012 | Kuhn | F41B 5/1426 124/25 |
| 8,408,195 | B2 * | 4/2013 | McPherson | F41B 5/1426 124/86 |
| 8,522,767 | B1 * | 9/2013 | Kuhn | F41B 5/1426 124/25 |
| 8,567,381 | B2 * | 10/2013 | Saunders | 124/86 |
| 8,950,388 | B2 * | 2/2015 | McPherson | F41B 5/1403 124/25.6 |
| 8,978,636 | B2 * | 3/2015 | Bednar | F41B 5/1407 124/25 |
| 9,038,617 | B1 * | 5/2015 | Khoshnood | F41B 5/1426 124/89 |
| 9,046,317 | B2 * | 6/2015 | McPherson | F41B 5/1426 |
| 9,097,487 | B2 * | 8/2015 | Kempf | F41B 5/1426 |
| 9,140,515 | B2 * | 9/2015 | Yi | F41B 5/1426 |
| 9,228,791 | B2 * | 1/2016 | Saunders | F41B 5/1426 |
| 2008/0264400 | A1 * | 10/2008 | Wright | F41B 5/1426 124/89 |
| 2012/0240913 | A1 * | 9/2012 | Stokes | F41B 5/1426 124/89 |

OTHER PUBLICATIONS

Screen of www.titaniumarcheryproducts/titanium-string-stop illustrating a string stop partially fabricated from titanium.

* cited by examiner

TITANIUM OFFSET STRING BUMPER

BACKGROUND OF THE INVENTION

1. Field of the Invention

The present invention relates generally to archery and more specifically to a titanium offset string bumper, which transmits less than 5% of the vibration energy from a bowstring striking thereof.

2. Discussion of the Prior Art

It appears that the prior art does not teach or suggest an offset string bumper fabricated from a titanium material. A titanium offset string bumper has the unexpected result of passing less than 5% of the vibration energy from a bowstring striking thereof and passing the vibration to a riser of an archery bow.

Accordingly, there is a clearly felt need in the art for a titanium offset string bumper, which transmits less than 5% of the vibration energy from a bowstring striking thereof.

SUMMARY OF THE INVENTION

The present invention provides a titanium offset string bumper, which transmits less than 5% of the vibration energy from a bowstring striking thereof. The titanium offset string bumper preferably includes a bumper rod and a rubber bumper. The bumper rod includes a base portion, an offset portion and a bumper portion. The bumper rod preferably includes a round cross section. The bumper rod is preferably fabricated from GR2 titanium. However, GR3, GR4 and GR5 titanium may also be used. A thread may be formed on one end of the base portion and one end of the offset portion extends from an opposing end of the base portion. The offset portion forms an angle of between 60-165 degrees relative to the base portion. One end of the bumper portion extends from an opposing end of the offset portion. The rubber bumper preferably includes an inwardly curved front to receive a bowstring and a rod bore sized to receive the bumper portion. The bumper portion is pushed into the rod bore of the rubber bumper. If the base portion includes the thread, a jam nut is used to secure the base portion in a threaded tap of a riser of an archery bow. If the thread is not formed on the base portion, the base portion make be retained in the riser with fasteners, a bonding agent or any other suitable method.

Accordingly, it is an object of the present invention to provide a titanium offset string bumper, which transmits less than 5% of the vibration energy from a bowstring striking thereof.

These and additional objects, advantages, features and benefits of the present invention will become apparent from the following specification.

DETAILED DESCRIPTION OF THE PREFERRED EMBODIMENTS

Figure 1:
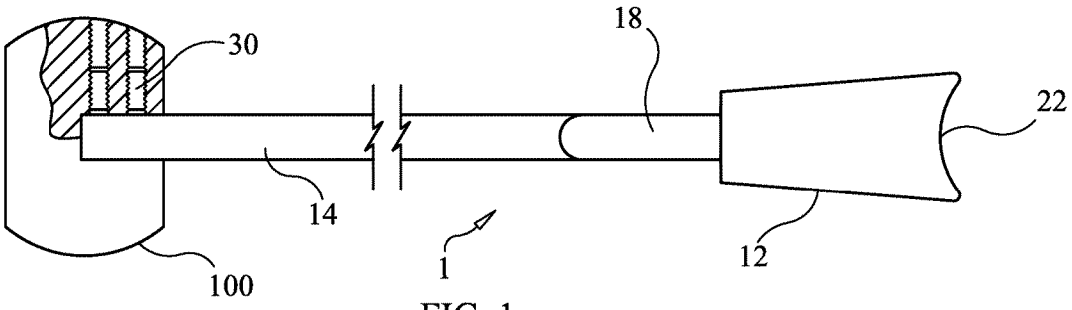
FIG. 1 is a side view of a titanium string bumper secured to a riser of an archery bow with a jam nut in accordance with the present invention.
Figure 2:
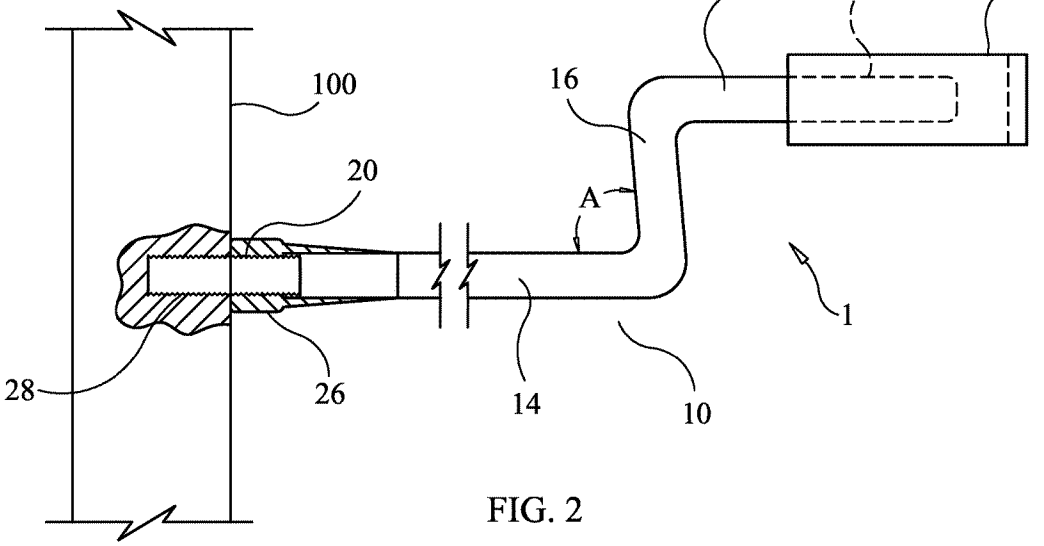
FIG. 2 is a top view of a titanium string bumper secured to a riser of an archery bow with two set screws threaded into the riser in accordance with the present invention.

With reference now to the drawings, and particularly to FIG. 1, there is shown a side view of a titanium offset string bumper 1. With reference to FIG. 2, the titanium offset string bumper 1 preferably includes a bumper rod 10 and a rubber bumper 12. The bumper rod 10 includes a base portion 14, an offset portion 16 and a bumper portion 18. The bumper rod 10 preferably includes a round cross section, but other shaped cross sections could also be used. The bumper rod 10 is preferably fabricated from GR2 titanium. However, GR3, GR4 and GR5 titanium may also be used. The GR2 titanium is the best at not transmitting vibration, because it is softer than the GR3, GR4 and GR 5 titanium. A thread 20 may be formed on one end of the base portion 14 and one end of the offset portion 16 extends from an opposing end of the base portion 14. The offset portion 16 forms an angle "A" of between 60-165 degrees relative to the base portion 14. One end of the bumper portion 18 extends from an opposing end of the offset portion 16. The base portion 14 is preferably substantially parallel to said bumper portion 18. The rubber bumper 12 preferably includes an inwardly curved front 22 to receive a bowstring and a rod bore 24 formed in a rear, which is sized to receive the bumper portion 18. The bumper portion 18 is pushed into the rod bore 24. If the base portion 14 includes the thread 20, a jam nut 26 is used to secure the base portion 14 in a threaded tap 28 of a riser 100 of an archery bow. If the thread 20 is not formed on the base portion 14, the base portion 14 may be retained in the riser with fasteners, such as set screws 30; a bonding agent; or any other suitable method.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A titanium offset string bumper comprising:

a bumper rod includes a base portion, an offset portion and a bumper portion, one end of said offset portion extends from said base portion at an angle of less than 90 degrees, one end of said bumper portion extends from an opposing end of said offset portion at an angle of less than 90 degrees, said offset portion is fixedly retained relative to said base portion and said bumper portion, said bumper rod is fabricated from titanium; and a rubber bumper includes a rod bore, said rod bore is sized to receive an opposing end of said bumper portion.

2. The titanium offset string bumper of claim 1 wherein: said base portion is substantially parallel to said bumper rod.

3. The titanium offset string bumper of claim 1 wherein: said rubber bumper includes an inwardly curved front and said rod bore formed in a rear thereof.

4. The titanium offset string bumper of claim 1 wherein: a thread is formed on an opposing end of said base portion, said base portion is threaded into a threaded tap in a riser of an archery bow.

5. The titanium offset string bumper of claim 1 wherein: an opposing end of said base portion is retained in a bumper bore of a riser of an archery bow with fasteners.

6. The titanium offset string bumper of claim 1 wherein: an opposing end of said base portion is retained in a bumper bore of a riser of an archery bow with a bonding agent.

7. A titanium offset string bumper comprising:

a bumper rod includes a base portion, an offset portion and a bumper portion, one end of said offset portion extends from said base portion at an angle of less than 90 degrees, one end of said bumper portion extends from an opposing end of said offset portion at an angle of less than 90 degrees, said offset portion is fixedly retained relative to said base portion and said bumper portion, said bumper rod is fabricated from titanium; and a rubber bumper includes a rod bore, said rod bore is sized to receive an opposing end of said bumper portion, wherein said base portion is retained in a riser of an archery bow.

8. The titanium offset string bumper of claim 7 wherein: said base portion is substantially parallel to said bumper rod.

9. The titanium offset string bumper of claim 7 wherein: said rubber bumper includes an inwardly curved front and said rod bore formed in a rear thereof.

10. The titanium offset string bumper of claim 7 wherein: a thread is formed on an opposing end of said base portion, said base portion is threaded into a threaded tap in a riser of an archery bow.

11. The titanium offset string bumper of claim 7 wherein: an opposing end of said base portion is retained in a bumper bore of a riser of an archery bow with fasteners.

12. The titanium offset string bumper of claim 7 wherein: an opposing end of said base portion is retained in a bumper bore of a riser of an archery bow with a bonding agent.

13. A titanium offset string bumper comprising:

a bumper rod includes a base portion, an offset portion and a bumper portion, one end of said offset portion extends from said base portion at an angle of less than 90 degrees, one end of said bumper portion extends from an opposing end of said offset portion at an angle of less than 90 degrees, said offset portion is fixedly retained relative to said base portion and said bumper portion, said bumper rod is fabricated as a unitary structure, said bumper rod is fabricated from one of a GR2, GR3, GR4 and GR5 titanium; and a rubber bumper includes a rod bore, said rod bore is sized to receive an opposing end of said bumper portion.

14. The titanium offset string bumper of claim 13 wherein:

said base portion is substantially parallel to said bumper rod.

15. The titanium offset string bumper of claim 13 wherein:

said rubber bumper includes an inwardly curved front and said rod bore formed in a rear thereof.

16. The titanium offset string bumper of claim 13 wherein:

a thread is formed on an opposing end of said base portion, said threaded is turned into a threaded tap is a riser of an archery bow.

17. The titanium offset string bumper of claim 13 wherein:

an opposing end of said base portion is retained in a bumper bore of a riser of an archery bow with fasteners.

18. The titanium offset string bumper of claim 13 wherein:

an opposing end of said base portion is retained in a bumper bore of a riser of an archery bow with a bonding agent.

* * * * *